US006431321B2

(12) United States Patent
Ach

(10) Patent No.: US 6,431,321 B2
(45) Date of Patent: Aug. 13, 2002

(54) TENSIONING DEVICE FOR AT LEAST ONE TRAILING ROPE OF AN ELEVATOR INSTALLATION

(75) Inventor: Ernst Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/820,148

(22) Filed: Mar. 28, 2001

(30) Foreign Application Priority Data

Mar. 31, 2000 (EP) ..... 00810281

(51) Int. Cl.[7] ..... B66B 7/10
(52) U.S. Cl. ..... 187/264; 187/412
(58) Field of Search ..... 187/264, 265, 187/412

(56) References Cited

U.S. PATENT DOCUMENTS 2,227,043 A * 12/1940 Tompkins ..... 187/264 X
2,385,488 A * 9/1945 Beatty ..... 187/412
3,810,529 A 5/1974 Tosato et al.
4,522,285 A 6/1985 Salmon et al.

FOREIGN PATENT DOCUMENTS

FR 2 639 132 5/1990
JP 06 211 465 8/1994

* cited by examiner

*Primary Examiner*—Steven A. Bratlie
(74) *Attorney, Agent, or Firm*—MacMillan, Sobanski & Todd, LLC

(57) ABSTRACT

A trailing rope tensioning device for an elevator installation includes at least one damper having at least one piston slidably received in a cylinder. The piston divides the cylinder into two chambers filled with a working fluid and connected together by a throttled connecting line as well as a channel fitted with a non-return valve. Attached to the piston is a fixed piston rod extending through the cylinder and emerging from ends of the cylinder. This arrangement requires no externally active container for damping.

12 Claims, 4 Drawing Sheets

TENSIONING DEVICE FOR AT LEAST ONE TRAILING ROPE OF AN ELEVATOR INSTALLATION

BACKGROUND OF THE INVENTION

The present invention relates to a tensioning device for at least one trailing rope of an elevator installation. Within the meaning of the invention, a trailing rope can also be a compensating rope, a compensating chain, or similar flexible connection. The terms "vertical" and "horizontal" relate to the direction of travel of the elevator. "Vertical" means the direction essentially parallel to the direction of travel of the elevator, and "horizontal" means the direction essentially perpendicular to it. The term "fluid" means some sort of gas or some sort of liquid.

Tensioning devices for trailing ropes have long been known, and are primarily used on traction elevators. The purpose of the tensioning device is, inter alia, to guide the trailing ropes, tension the trailing ropes, limit rope vibrations, increase traction, and prevent the counterweight or elevator car from jumping when the safety gear of the car or counterweight is actuated, or when the car or counterweight strikes the buffer. At speeds of 3.5 m/s and above, the tensioning device must be fitted with an anti-rebound device. Present-day anti-rebound devices consist, for example, of safety gears which trip when the tensioning device moves upward by a specified amount. Just this specified amount has disadvantageous effects. The trailing ropes are tensioned by the jumping counterweight (elastic members) and accelerate the counterweight as it falls back down. The forces that occur when the counterweight falls back onto the suspension rope are also correspondingly large. Moreover, with this known solution, when once the safety gear has tripped, the tensioning device has to be released manually. Only trained personnel are allowed to release it. The need for manual release is due to the system.

Investigations carried out using simulation have shown clearly that almost entirely undamped tensioning devices influence the characteristics of the installation negatively.

Damped tensioning devices are known, and have the advantage that when required they remove energy from the system, as a result of which the energy of the counterweight is reduced as it falls back down.

The U.S. Pat. No. 4,522,285 shows an anti-rebound device in which the vertical motion/damping of the trailing rope tensioning pulley is controlled by a hydraulic system. The system comprises a cylinder and a piston that moves inside the cylinder and divides the cylinder into two chambers. The piston rod is connected at one end to the piston, and at the other end to the tensioning pulley. Due to the one-sided arrangement of the piston rod, the displacement volume on the side of the piston with the piston rod is smaller than on the side where there is no piston rod. To balance the volume/pressure of the two chambers, outside the cylinder there is a container filled with hydraulic fluid, which works actively in conjunction with the two chambers.

A disadvantage of this known construction is the complicated arrangement of the valves, and the inevitable necessity of an externally acting compensating container, which causes the construction of the tensioning device to be costly and complicated.

SUMMARY OF THE INVENTION

The present invention concerns a tensioning device for at least one trailing rope that does not possess the aforementioned disadvantages, allows a simple construction, and needs no external compensation container. Damping of the tensioning device is achieved by simple means.

A further advantage is to be seen in that the tensioning device according to the present invention can be manufactured inexpensively.

A further advantage of the present invention is that the cylinder and piston rod form a guide system for the tensioning device.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
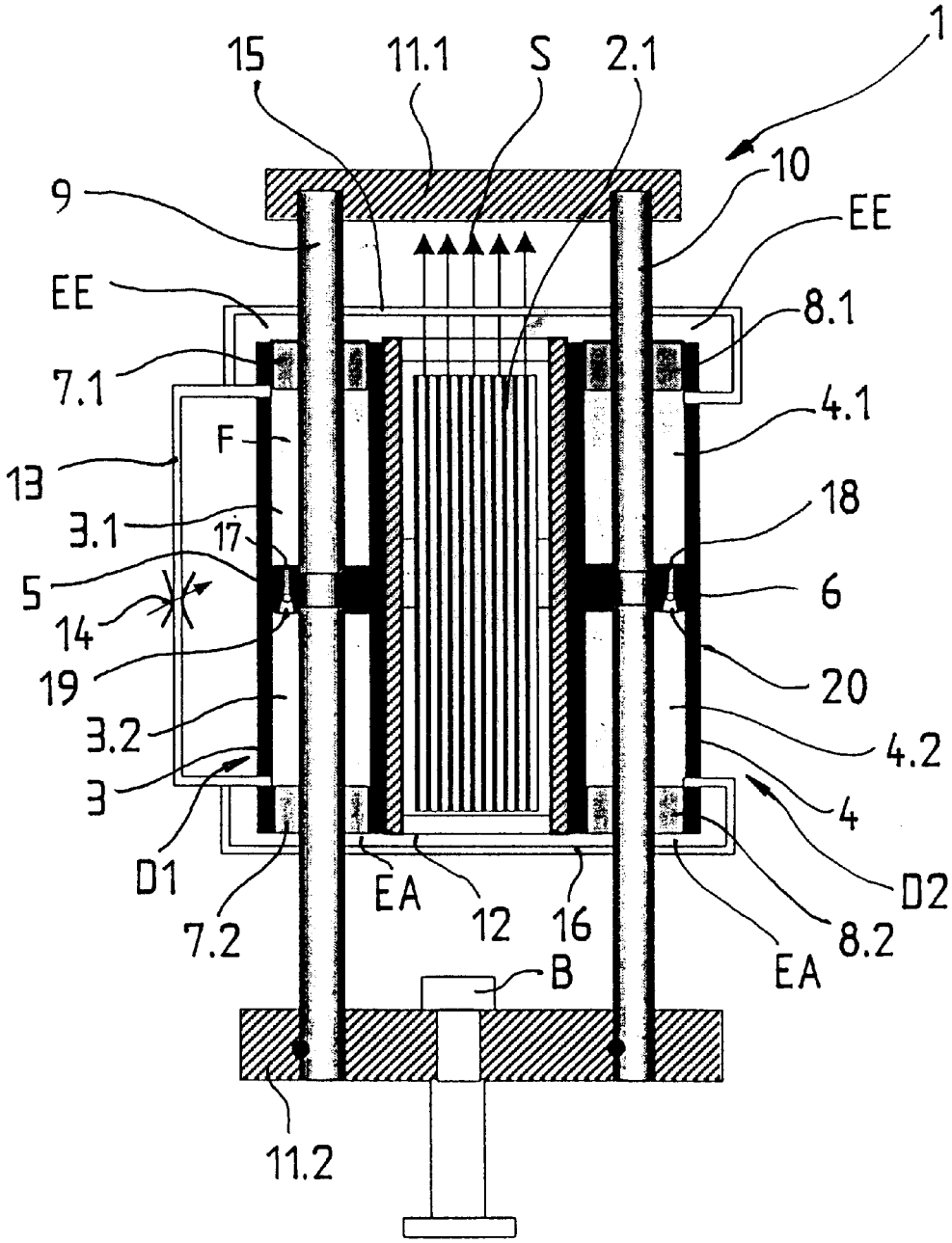
FIG. 1 is a partial cross-sectional side elevation view of a trailing rope tensioning device in accordance with a first embodiment the present invention.

FIG. 1 shows in a side view a trailing rope tensioning device 1 in which a tensioning pulley 2.1 is rotatably mounted between a first double-acting cylinder 3 and a second double-acting cylinder 4. The cylinders 3 and 4 are constructed as elements of damping means D1 and D2 respectively, and therefore act as hydraulic or pneumatic dampers. Wrapped around a periphery of the tensioning pulley 2.1 are trailing ropes S that connect an elevator car (not shown) to a counterweight (not shown) in the normal way. The first double-acting cylinder 3 has an upper chamber 3.1 and a lower chamber 3.2 that are separated by a first piston 5. The second double-acting cylinder 4 has an upper chamber 4.1 and a lower chamber 4.2 that are separated by a second piston 6. The chambers 3.1, 3.2, 4.1 and 4.2 contain inside them as a working substance a fluid F, for example oil. On a first end EE of the first cylinder 3, above the upper chamber 3.1, is an upper seal 7.1, and on the other, second end EA of the first cylinder 3, below the lower chamber 3.2, is a lower seal 7.2. In the same manner, the second cylinder 4 has an upper seal 8.1 above the upper chamber 4.1 and a lower seal 8.2 below the lower chamber 4.2.

A first, preferably column-shaped piston rod 9 extends vertically, and therefore axially, over at least the entire length of the first cylinder 3, and over at least a length corresponding to the length of the cylinder 3 plus the length of the stroke of the rod. The first piston rod 9 runs concentrically within the first cylinder 3, and is joined to the first piston 5 by means of, for example, a thread. Above the first piston 5, the piston rod 9 passes through the upper chamber 3.1 and through the upper seal 7.1 of the first cylinder 3. In the same way, below the first piston 5, the piston rod 9 passes through the lower chamber 3.2 and through the lower seal 7.2 of the first cylinder 3.

In a manner similar to the first cylinder 3, a second, preferably column-shaped piston rod 10 extends vertically over at least the entire length of the second cylinder 4, and specifically over at least a length which corresponds to the length of the cylinder 4 plus the length of stroke. The second piston rod 10 runs concentrically within the second cylinder 4 and is connected to the second piston 6. Above the second piston 6, the piston rod 10 passes through the upper chamber 4.1 and the upper seal 8.1 of the second cylinder 4. In the same manner, below the second piston 6, the piston rod 10 passes through the lower chamber 4.2 and through the lower seal 8.2 of the second cylinder 4. The seals 7.1, 7.2, 8.1 and 8.2 are arranged movably on the respective piston rods 9 and 10.

In this manner the first piston rod 9 is arranged so as to be on both sides of the first piston 5. This has the effect that the volume of displacement in the upper chamber 3.1 of the first cylinder 3 is the same as the volume of displacement in the lower chamber 3.2 of the first cylinder 3. The same obviously applies for the second piston rod 10 in the second cylinder 4.

This makes it unnecessary to have an external compensating vessel acting to compensate the volume.

The first piston rod 9 and the second piston rod 10 are permanently connected at both ends to an immovable structure. The structure preferably has an upper support 11.1 and a lower support 11.2, which supports are arranged above and below respectively the two cylinders 3 and 4, and to which the first piston rod 9 and the second piston rod 10 are fastened. For this reason, the piston rods 9 and 10 together with the pistons 5 and 6 are immovable in relation to the structure supports 11.1 and 11.2. The lower support 11.2 is preferably fastened to the hoist way floor by a fastening means B.

The tensioning pulley 2.1 is rotatably mounted in a frame 12. The frame 12 is connected laterally to the cylinders 3 and 4 by means of, for example, screws (not shown). The first piston rod 9 and the second piston rod 10 take the form of a guide for the first cylinder 3 and the second cylinder 4 respectively. In this way, the associated piston rod and cylinder forms a guide system for the moving part of the trailing rope tensioning device 1, which means that when the tensioning pulley moves, the two cylinders 3 and 4 together with the respective seals 7.1, 7.2, 8.1 and 8.2 are moved along the two piston rods 9 and 10 and guided by them. Because the two pistons 5 and 6 are connected to the respective piston rods 9 and 10, they also remain fixed while the tensioning device moves.

The upper chamber 3.1 of the first cylinder 3 is connected in fluid communication to the lower chamber 3.2 of the first cylinder 3 by a connecting line 13 that has a throttle 14. In this embodiment, the connecting line 13, hereinafter also referred to as the throttled connecting line 13, ends in the vicinity of the upper seal 7.1 and the lower seal 7.2 of the first cylinder 3. The throttled line 13 is also connected by a first line 15 to the upper chamber 4.1 of the second cylinder 4. The first line 15 could also directly connect the upper chamber 3.1 of the first cylinder 3 to the upper chamber 4.1 of the second cylinder 4. In the same manner, the throttled line 13 is connected by a second line 16 to the lower chamber 4.2 of the second cylinder 4. The second line 16 could also directly connect the lower chamber 3.2 of the first cylinder 3 to the lower chamber 4.2 of the second cylinder 4. The purpose of the first line 15 and the second line 16 is to feed the fluid stream of the two cylinders 3 and 4 through the common throttle 14.

The first piston 5 and the second piston 6 each have a channel 17 and 18 respectively which connects the upper chambers 3.1 and 4.1 of the first cylinder 3 and second cylinder 4 respectively to the corresponding lower chambers 3.1 and 4.2 of the first cylinder 3 and second cylinder 4 respectively. These channels 17 and 18 each have a non-return valve, 19 and 20 respectively, which in this embodiment allows fluid to flow from the upper chambers 3.1 and 4.1 into the lower chambers, 3.2 and 4.2 respectively, and prevent it from flowing in the opposite direction.

For the sake of simplicity, in FIGS. 2 to 5 the same elements are shown with the same reference numbers as in FIG. 1.

Figure 2:
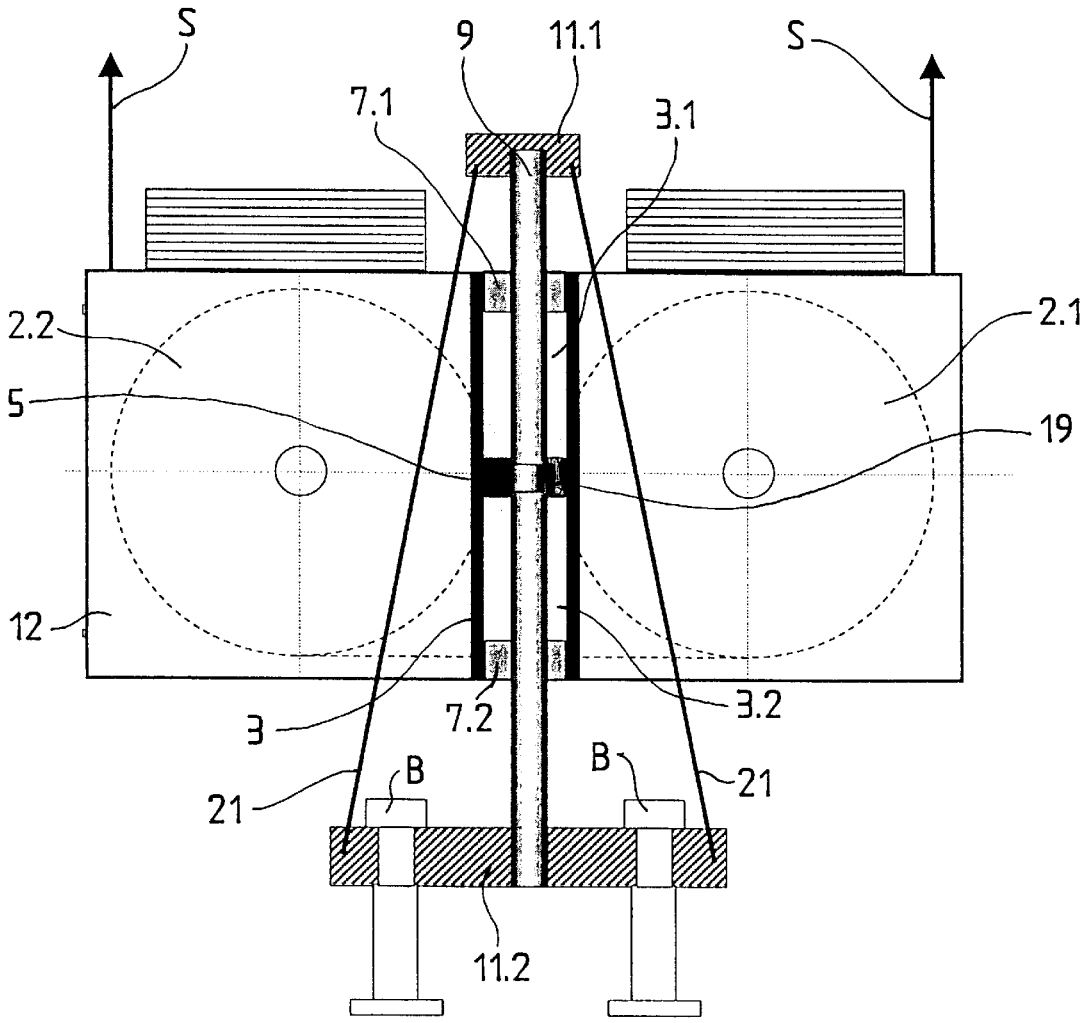
FIG. 2 is partial cross-sectional front elevation view of the tensioning device shown in FIG. 1.

FIG. 2 shows a front view of the tensioning device shown in FIG. 1, in which two tension pulleys 2.1 and 2.2 are rotatably mounted in the frame 12, and the cylinder 3 is connected to the frame 12. It can be seen more clearly in this figure how in this embodiment the respective elements of the tensioning device are arranged in relation to each other. To increase the stability of the structure with the supports 11.1 and 11.2, there are also braces 21 connecting the upper support 11.1 to the lower support 11.2.

Figure 3:
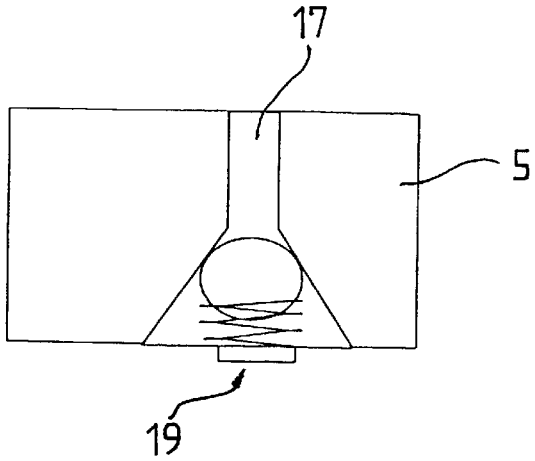
FIG. 3 is an enlarged schematic view of the first piston shown in FIG. 1.

FIG. 3 shows an enlarged schematic view of the non-return valve 19 of the first cylinder 3 in the first piston 5. This is preferably a normal non-return valve 19, through which the fluid can only flow downward. The same applies to the non-return valve 20 of the second cylinder 4.

Figure 4:
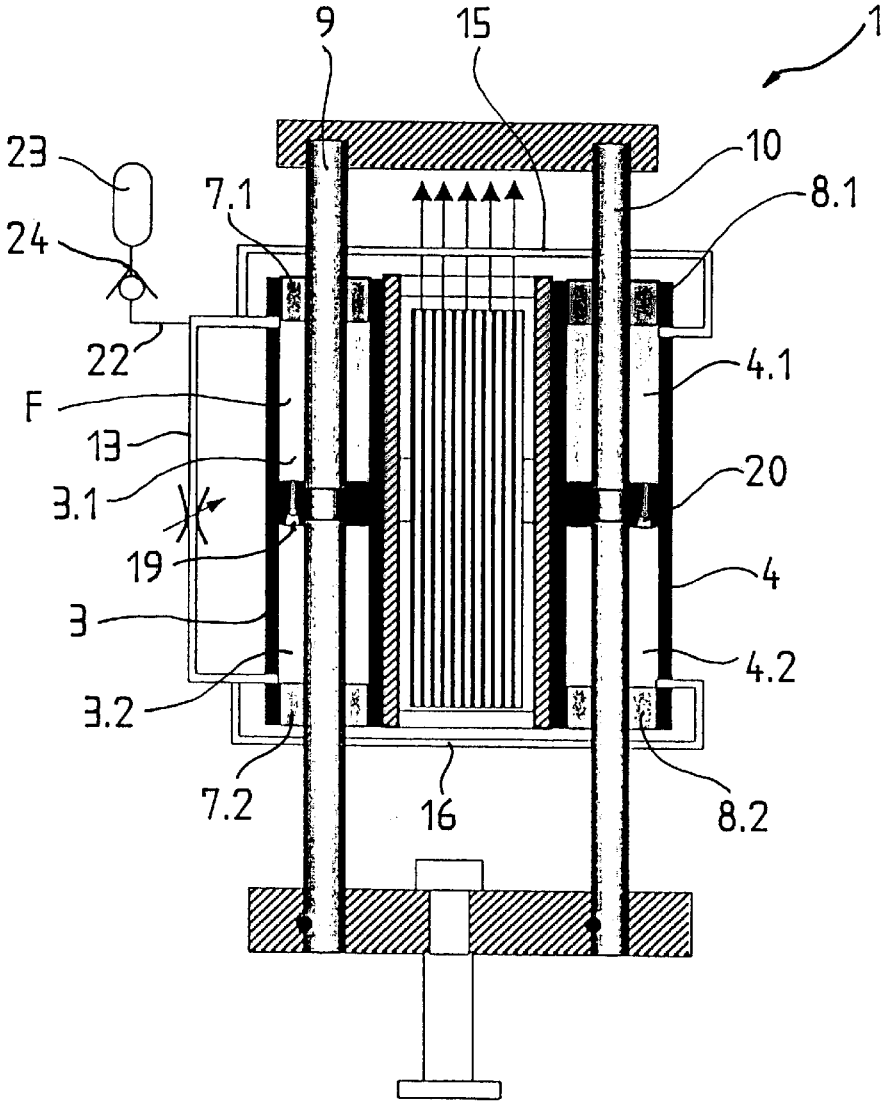
FIG. 4 is view similar to FIG. 1 of a trailing rope tensioning device in accordance with a second embodiment the present invention.

FIG. 4 shows a second preferred embodiment of the present invention, which corresponds in essence to the embodiment shown in FIGS. 1 and 2. Connected to the throttled connecting line 13 via a third line 22 is a reservoir 23. The function of the reservoir 23 is to compensate for the leakage that can occur through the seals 7.1, 7.2, 8.1 and 8.2 of the two cylinders 3 and 4. The third line 22 has a further non-return valve 24, so that the fluid can only flow in one direction. In another embodiment, the reservoir 23 could be formed as a pressure reservoir in which the fillness of the reservoir 23 can be monitored by, for example, a pressure switch not shown here.

There now follows a more detailed explanation of the functional principle by reference to FIG. 4:

By way of example, the case will be considered in which the elevator car safety gear is actuated. The working fluid used is oil. The trailing ropes S connect the underside of the elevator car to the underside of the counterweight via a tensioning pulley arranged on the floor of the hoist way.

If the safety gear on the car is actuated, the car and counterweight are decelerated at different rates. Due to the sudden stopping of the car, the counterweight will jump upward, which causes a tension in the trailing ropes. The rope force is generated when the counterweight continues to move upward when the car is stationary. This leads to a sudden upward movement of the tensioning pulleys. When this occurs, oil flows from the lower oil chambers 3.2 and 4.2 of the two cylinders 3 and 4, via the connecting line 13, the throttle 14, and the lines 15 and 16, into the upper oil chambers 3.1 and 4.1 of the two cylinders 3 and 4. The upwardly directed, jerking movement is damped by the tensioning device according to the present invention. The adjustable throttle 14 determines the damping effect.

When the rope tension decreases, the tensioning device 1 tends toward its lowest position, and the oil from the upper chambers 3.1 and 4.1 of the cylinders 3 and 4 flows mainly through the non-return valves 19 and 20 into the lower chambers 3.2 and 4.2 of the cylinders 3 and 4. The non-return valve allows rapid lowering of the tensioning pulleys, and rapid retensioning.

The small reservoir 23 with the non-return valve 24 compensates possible leakage. Its fullness can be monitored, for example, electrically.

Figure 5:
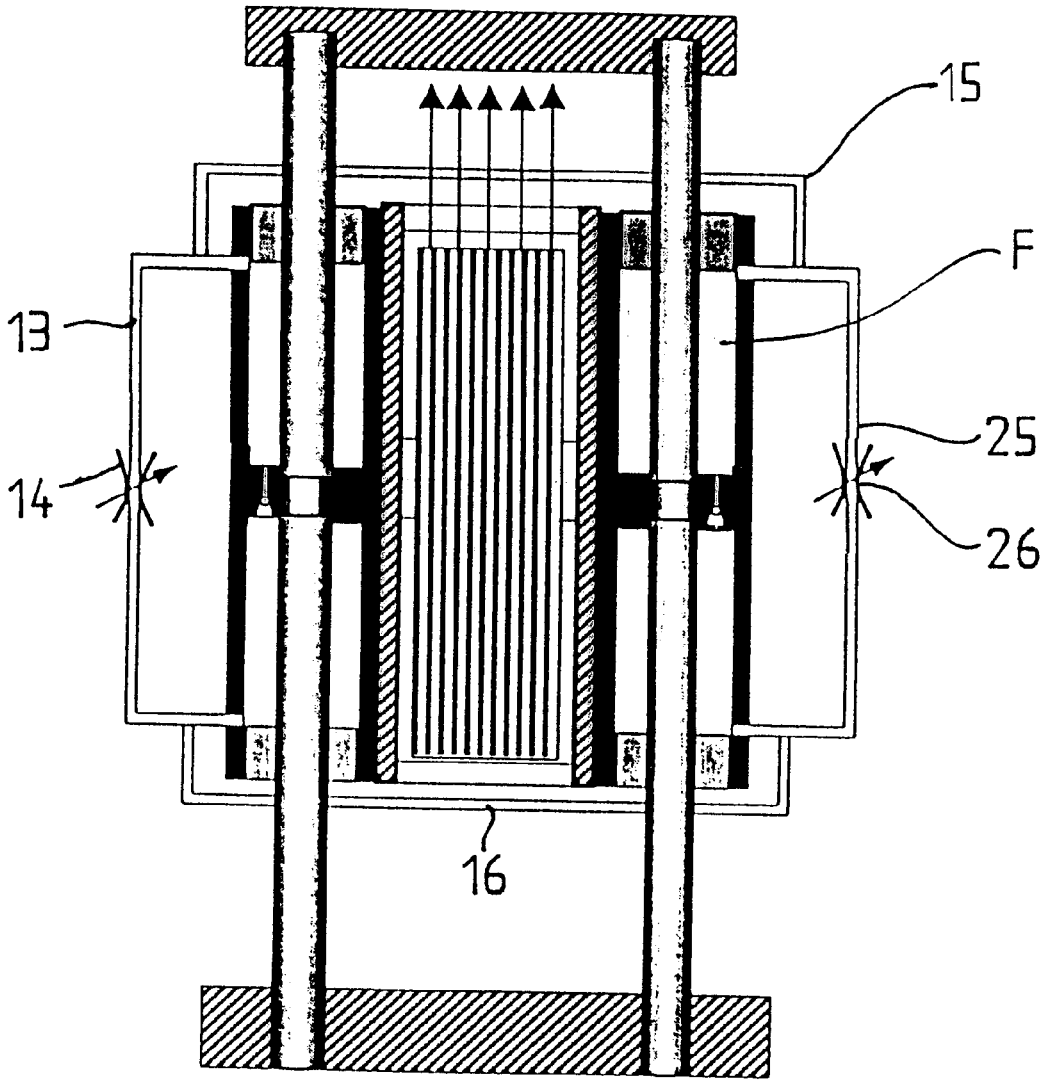
FIG. 5 is view similar to FIG. 1 of a trailing rope tensioning device in accordance with a third embodiment the present invention.

FIG. 5 shows a further, third embodiment of the present invention. Here, by comparison with the embodiments according to FIGS. 1 to 4, a further throttled line 25 is added in addition to the throttled line 13 already mentioned, to connect the upper chamber 4.1 of the second cylinder 4 to the lower chamber 4.2 of the second cylinder 4. The further throttled line 25 has a further throttle 26. As a result, the flow of the fluid F could be adjusted in the two cylinders 3 and 4 independent of each other. In this embodiment, the first line 15 and the second line 16 could possibly be dispensed with if, for example, the throttle 14 and the further throttle 26 are set identically, and the throttled connecting lines 13 and 25 are of equal size. The two lines 15 and 16 can particularly be of assistance if the two throttles 14 and 26 are set differently.

Although the description relates mainly to a trailing rope tensioning device fitted with hydraulic dampers, it is self-evidently also possible in the same manner and with the same function/effect to equip the trailing rope tensioning device according to the invention with pneumatic dampers. In this case a gaseous medium is used as the working fluid.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A damping apparatus for tensioning at least one trailing rope of an elevator installation, the rope engaging at least one tensioning pulley, comprising:

a cylinder closed at opposite ends and adapted to be coupled to the pulley;

a piston slidably received in and dividing said cylinder into two chambers, said chambers being filled with a damping fluid;

a throttled connecting line attached to said cylinder and connecting said chambers in fluid communication;

a channel in fluid communication with said chambers and provided with a non-return valve for permitting flow of said fluid between said chambers in only one direction; and a piston rod attached to said piston and extending from said opposite ends of said cylinder whereby when said cylinder is coupled to the pulley, movement of the pulley in a predetermined direction relative to and along a longitudinal axis of said rod moves said cylinder relative to said piston and the movement of the pulley is damped by the flow of said fluid through said connecting line.

2. The apparatus according to claim 1 wherein said piston rod functions as a guide for the movement of said cylinder.

3. The apparatus according to claim 1 wherein said fluid is one of a pneumatic type and a hydraulic type.

4. The apparatus according to claim 1 wherein said cylinder is concentric with said piston rod.

5. The apparatus according to claim 1 wherein said cylinder is mounted on a frame for coupling to the pulley.

6. The apparatus according to claim 1 wherein said channel with said non-return valve is formed through said piston.

7. The apparatus according to claim 1 wherein said cylinder has seals at said opposite ends for sealing against said piston rod.

8. The apparatus according to claim 1 including a reservoir connected to said connecting line for compensating a possible leakage of said fluid.

9. The apparatus according to claim 1 wherein said damping apparatus is a first damping apparatus and including a second said damping apparatus, said chambers in said cylinder of said first damping apparatus being connected in fluid communication with corresponding chambers of a cylinder of said second damping apparatus.

10. A damping apparatus for tensioning at least one trailing rope of an elevator installation, comprising:

at least one tensioning pulley for engagement with the trailing rope;

a cylinder closed at opposite ends and coupled to said pulley;

a piston slidably received in and dividing said cylinder into two chambers, said chambers being filled with a damping fluid;

a throttled connecting line attached to said cylinder and connecting said chambers in fluid communication;

a channel in fluid communication with said chambers and provided with a non-return valve for permitting flow of said fluid between said chambers in only one direction; and a piston rod attached to said piston and extending from said opposite ends of said cylinder whereby movement of said pulley in a predetermined direction relative to and along a longitudinal axis of said rod moves said cylinder relative to said piston and the movement of said pulley is damped by the flow of said fluid through said connecting line.

11. The apparatus according to claim 10 including a second tensioning pulley coupled to said cylinder.

12. A damping apparatus for tensioning at least one trailing rope of an elevator installation, the rope engaging at least one tensioning pulley, comprising:

a pair of cylinders each closed at opposite ends and adapted to be coupled to the pulley;

a pair of pistons each slidably received in and dividing an associated one of said cylinders into two chambers, said chambers being filled with a damping fluid;

a throttled connecting line attached to one of said cylinders and connecting said chambers of said one cylinder in fluid communication;

a channel in fluid communication with said chambers of each said cylinder and provided with a non-return valve for permitting flow of said fluid between said chambers in only one direction; and a pair of piston rods each attached to an associated one of said pistons and extending from said opposite ends of an associated one of said cylinders whereby when said cylinders are coupled to the pulley, movement of the pulley in a predetermined direction relative to and along a longitudinal axis of said rods moves said cylinders relative to said pistons and the movement of the pulley is damped by the flow of said fluid through said connecting line.

* * * * *